US005951343A

United States Patent [19]

Nanami et al.

[11] Patent Number: 5,951,343

[45] **Date of Patent: *Sep. 14, 1999**

[54] ENGINE LUBRICATING SYSTEM FOR WATERCRAFT

[75] Inventors: Masayoshi Nanami; Toshiyuki Hattori, both of Iwata, Japan

[73] Assignee: Yamaha Hatsudoki Kabushiki Kaisha, Shizuoka-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/149,329

[22] Filed: Sep. 8, 1998

Related U.S. Application Data

[62] Division of application No. 08/818,614, Mar. 14, 1997, Pat. No. 5,839,930.

[30] Foreign Application Priority Data

Mar. 15, 1996 [JP] Japan ..... 8-59384
Aug. 29, 1996 [JP] Japan ..... 8-228666

[51] Int. Cl.[6] ..... B63H 21/10

[52] U.S. Cl. ..... 440/88; 114/270; 123/196 R; 123/196 AB

[58] Field of Search ..... 440/88, 89; 114/270; 123/195 S, 196 R, 196 S, 196 AB

[56] References Cited

U.S. PATENT DOCUMENTS 5,167,207 12/1992 Gohara et al. ..... 123/196 R
5,195,481 3/1993 Oyama et al. ..... 123/196 R
5,239,957 8/1993 Gohara et al. ..... 123/196 S
5,743,206 4/1998 Hattori ..... 440/89

*Primary Examiner*—Jesus D. Sotelo
*Attorney, Agent, or Firm*—Knobbe, Martens, Olson & Bear LLP

[57] ABSTRACT

A lubricating system for a four-cycle engine positioned within an engine compartment of a personal watercraft for powering a water propulsion unit thereof, is disclosed. The engine compartment, and engine therein, is accessible through a maintenance opening in deck of the watercraft. Preferably, the lubricating system includes an oil filter which is positioned at other than the bottom of the engine for access through the maintenance opening, such as at the front or rear end of the engine. In addition, the engine preferably includes an oil drain which is positioned below the oil filter for draining the oil from the engine.

19 Claims, 15 Drawing Sheets

ENGINE LUBRICATING SYSTEM FOR WATERCRAFT

CROSS REFERENCE TO RELATED APPLICATION

This application is a division of U.S. Ser. No. 08/818,614, filed on Mar. 14, 1997, now allowed.

FIELD OF THE INVENTION

The present invention relates to a lubricating system for an internal combustion engine. More particularly, the present invention relates to a lubricating system for a four-cycle engine for use in powering a water propulsion device of a watercraft.

BACKGROUND OF THE INVENTION

Two-cycle engines are used to power watercraft, including smaller watercraft known as "personal" watercraft. These engines have the advantage that they are fairly powerful, and relatively lightweight and compact.

One particular disadvantage to the two-cycle engine is its emission content. Two-cycle engines exhaust large quantities of carbon monoxide (CO) and various hydrocarbons. When measures are taken to reduce the emission content of the two-cycle engine, other generally undesirable consequences result, such as an increase in the weight of the engine, a reduction of its power output or the like.

Four-cycle engines are commonly used as a power plant in other applications, such as automobiles. These engines have the advantage that their emission content is desirably lower and the engines have a high power output.

On the other hand, four-cycle engines are generally arranged with oil-filled crankcases or reservoirs positioned at the bottom of the cylinder block. In addition, the oil filter is positioned at the bottom of the engine. This impedes use of the four-cycle engine in this type of watercraft. In particular, when this type of engine is mounted in a watercraft in a manner in which the drive shaft is generally horizontally extending, the oil reservoir and oil filter are positioned under the engine adjacent the hull. This arrangement prevents the watercraft's owner from being able to service the engine, including replacing the oil and oil filter, through a service access which is normally provided in the top deck of the hull.

It is desired to provide a watercraft with a four-cycle engine having a lubricating system which is accessible for servicing and the like.

SUMMARY OF THE INVENTION

In accordance with the present invention there is provided a lubricating system for a four-cycle internal combustion engine particularly suited to watercraft applications. The watercraft is preferably of the personal watercraft variety, having an enclosed engine compartment which is accessible by exposing a maintenance opening under a seat.

The lubricating system includes an oil reservoir, means for delivering oil from the reservoir through the engine back to the reservoir, and an oil filter through which the oil passes for filtering. The oil filter is positioned at other than a bottom of the engine for access through the maintenance opening.

In one preferred embodiment of the present invention, the lubricating system is of the dry-sump type. The engine includes an oil collector at a bottom thereof, with an oil reservoir mounted externally of the hull near a steering handle. In this arrangement, lubricant is supplied from the reservoir through a supply line to a port in the engine. The lubricant is pumped through an oil filter which is accessible from the maintenance opening, preferably extending from the front end of the engine. The lubricant passes through the engine to the collector and is then pumped back to the reservoir. Advantageously, the engine is provided with an oil fill or spout positioned in a top surface of a camshaft cover at the top of the engine.

In another embodiment of the present invention, the oil filter is conveniently located at the rear end of the engine.

In yet another embodiment of the present invention, the combustion chambers of the engine are tilted from a vertical plane extending through the crankshaft. The oil filter is positioned on a side of the engine facing generally upward towards the maintenance opening. In a first arrangement, the oil fill or spout is positioned between the vertical plane and the plane through the combustion chambers, and extends vertically upward from the camshaft cover. In a second arrangement, the oil fill or spout is positioned below the plane extending through the combustion chambers and is accessible through a covered port in a side portion of the deck of the watercraft.

As another aspect of the present invention, the oil reservoir may be supported by the engine within the engine compartment of the watercraft. In this arrangement, an oil fill or spout is provided in the top surface of the reservoir facing the maintenance opening. In addition, the oil filter is mounted to the reservoir for access through the opening.

The engine may also include an oil drain for draining oil from the engine. A water drain may also be included for draining water from the engine compartment. Preferably, an oil filter of the engine is positioned above the drains.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
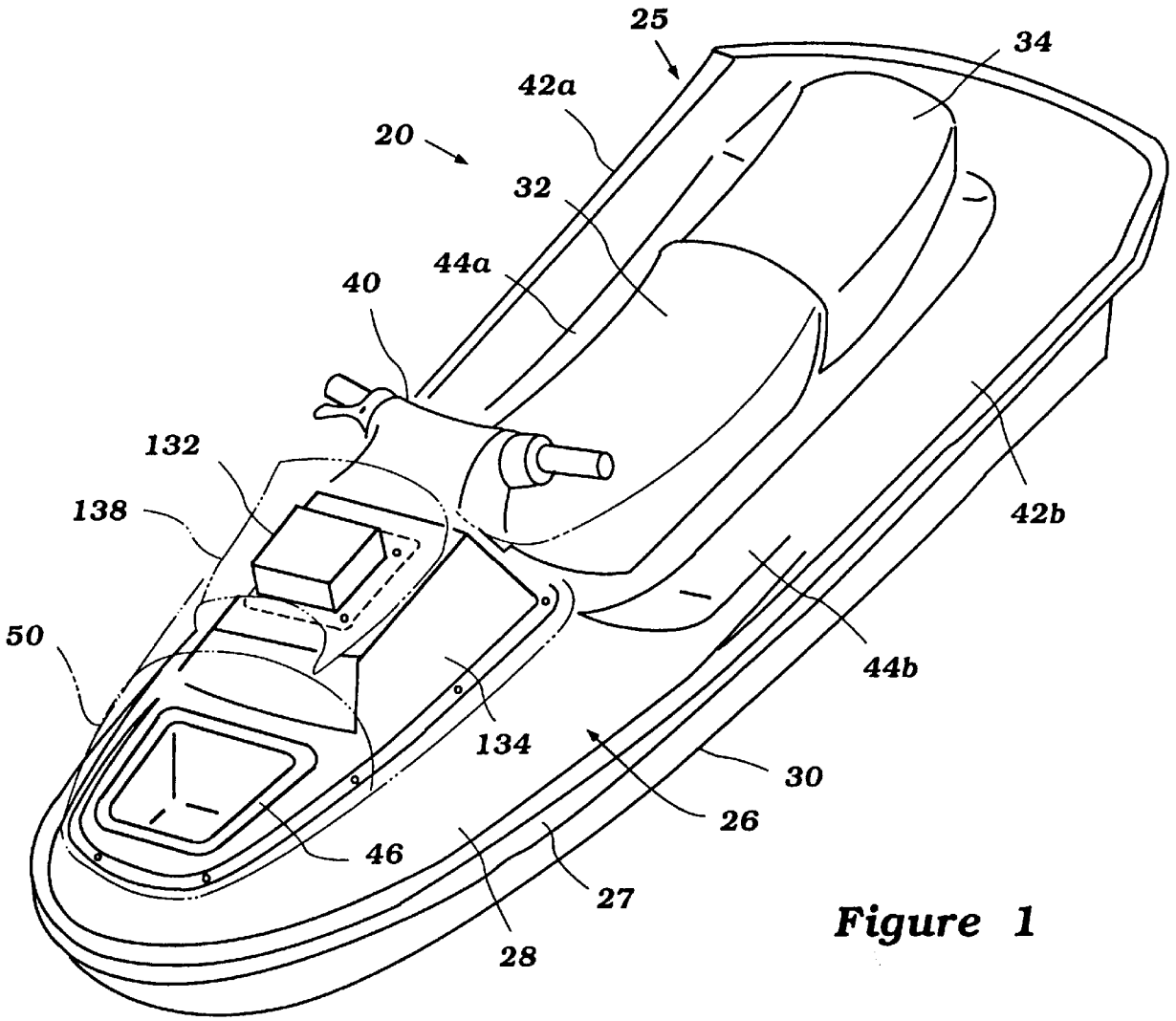
FIG. 1 is a perspective view of a watercraft of the type for powering by an engine having a lubricating system in accordance with the present invention.

FIGS. 1–7 illustrate a watercraft 20 powered by an engine 22 having a lubricating system in accordance with a first embodiment of the present invention. As illustrated, the watercraft 20 generally comprises a watercraft body 25 having the engine 22 mounted therein for powering a water propulsion device.

The watercraft body 25 preferably comprises a hull 26 having a top portion or deck 28 and a lower portion 30. A gunnel 27 defines the intersection of the lower portion 30 of the hull 26 and the deck 28. In addition, the body 25 includes a front seat 32 and a rear seat 34 positioned on the top portion 28 of the hull 26. The front seat 32 is preferably connected to a first removable deck member 36 (see FIG. 2). The rear seat 34 is preferably connected to a second removable deck member 38. A steering handle 40 is provided adjacent the front seat 32 for use by a user in directing the watercraft 20.

A bulwark 42*a,b* extends upwardly along each side of the watercraft 20. A foot step area 44*a,b* is defined between each seat 32,34 and its adjacent bulwark 42*a,b*.

Figure 2:
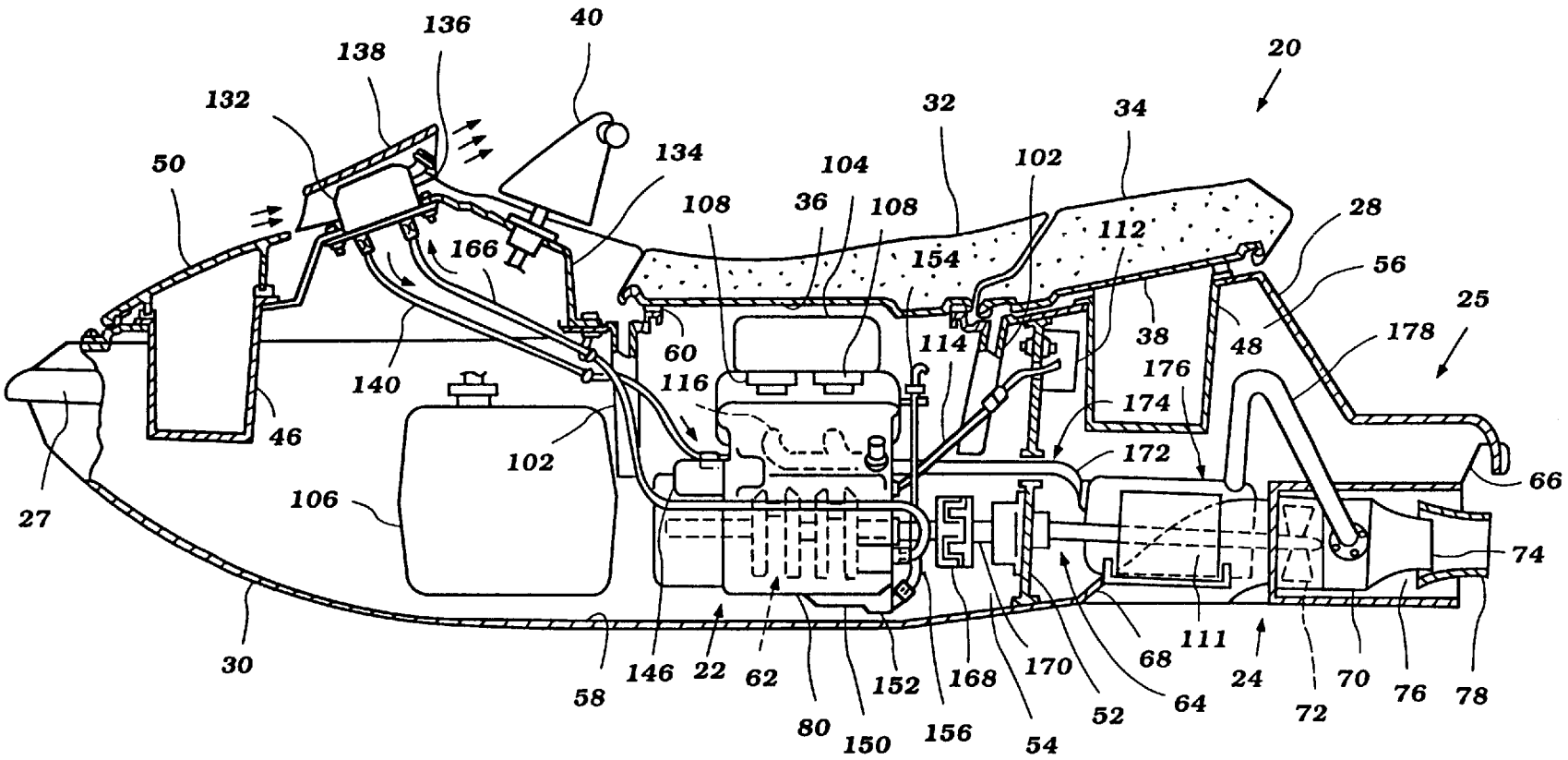
FIG. 2 is a cross-sectional side view of the watercraft illustrated in FIG. 1 as powered by an engine having a lubricating system in accordance with a first embodiment of the present invention.
Figure 3:
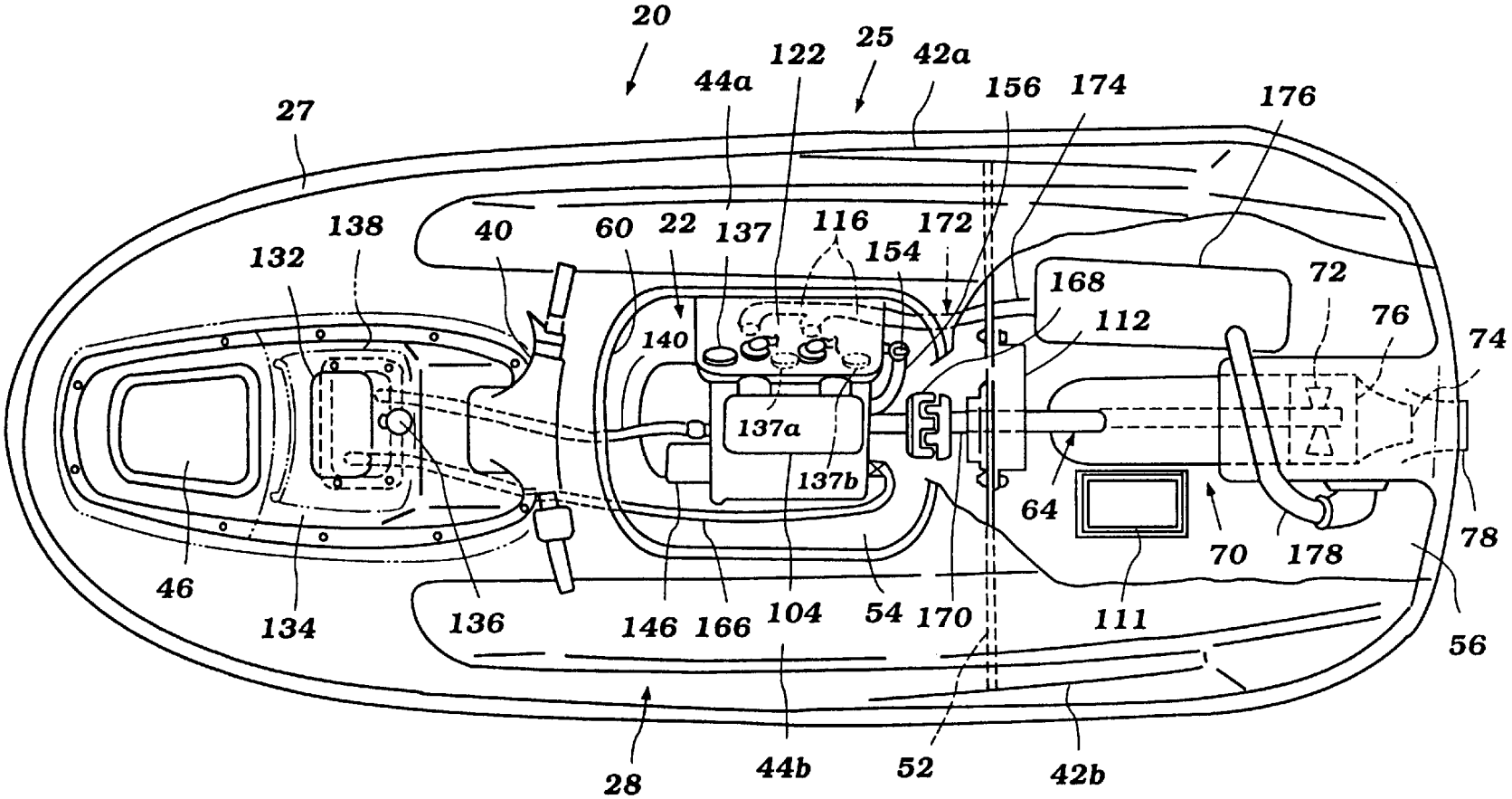
FIG. 3 is a top view of the watercraft illustrated in FIG. 2, with portions cut-away to expose the engine thereof.

The watercraft 20 as illustrated in FIG. 2 includes a pair of storage boxes 46,48. A rear storage box 48 is preferably positioned underneath the rear seat 34 and is accessible by removing the second removable deck member 38. The front storage box 46 is preferably a recessed area in the top or lid portion 28 of the hull 26 at the bow of the craft, and includes a cover 50 selectively extendible over the storage box 48 for protecting the items therein from water and the like.

Figure 4:
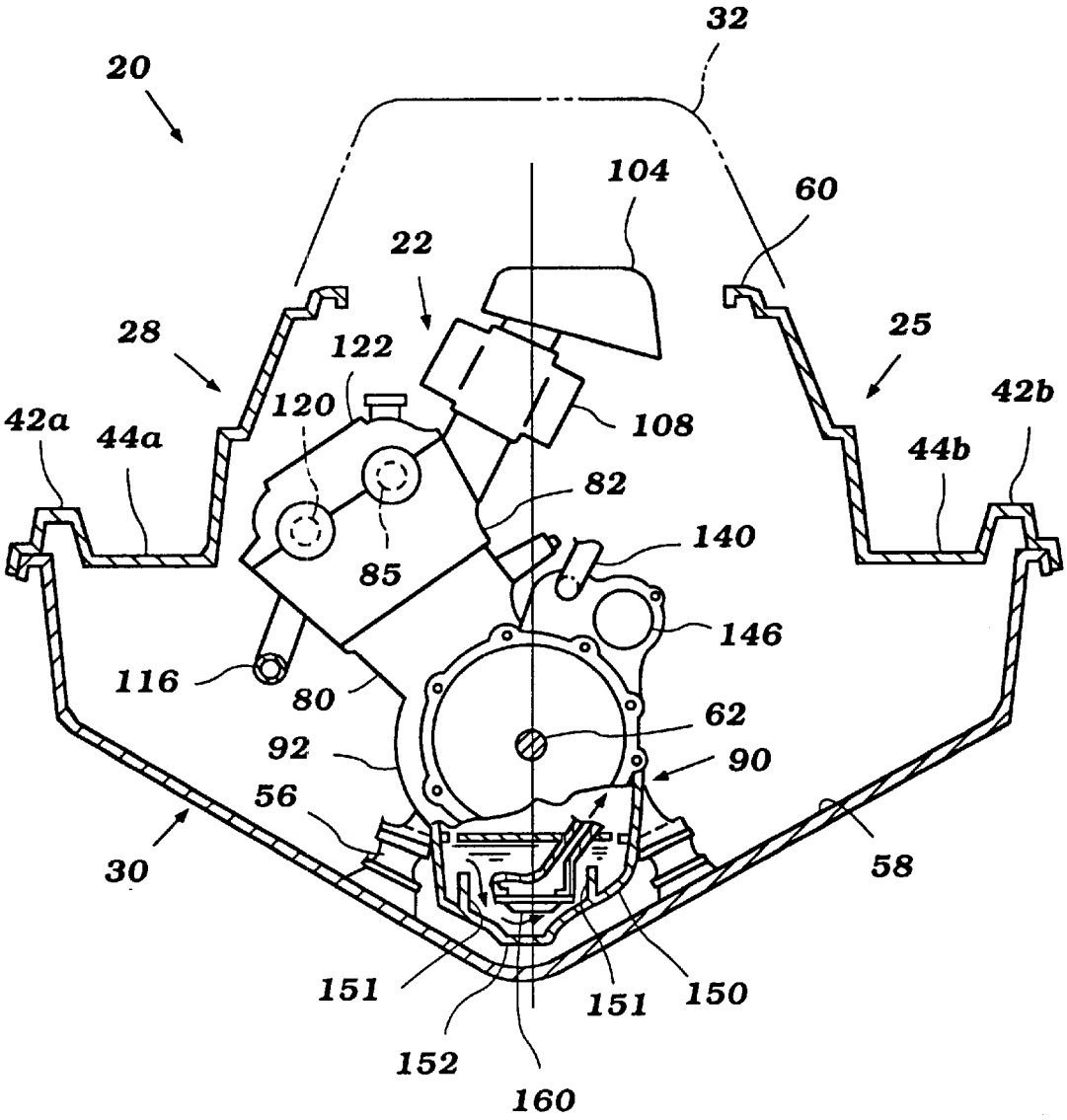
FIG. 4 is a cross-sectional front view of the watercraft illustrated in FIG. 2, exposing the engine therein, with the engine illustrated in partial cross-section.

The top and bottom portions 28,30 of the hull 26, along with a bulkhead 52, define an engine compartment 54 and a pumping compartment or chamber 56. The engine 22 is positioned in the engine compartment 54. As best illustrated in FIG. 4, the engine 22 is connected to the hull 26 via several engine mounts 56 connected to a bottom 58 of the lower portion 30 of the hull 26. The engine 22 is preferably partially accessible through a maintenance opening 60 which is itself accessible by removing the first removable deck member 36 on which the front seat 32 is mounted.

The engine 22 has a crankshaft 62 which is in driving relation with an impeller shaft 64. The impeller shaft 64 rotationally drives a means for propelling water of the propulsion unit 24, which unit extends out a stern portion 66 of the watercraft 20.

The propulsion unit 24 includes a propulsion passage 70 having an intake port 68 which extends through the lower portion 30 of the hull 26. The means for propelling water, preferably an impeller 72 driven by the impeller shaft 64, is positioned in the passage 70. The passage 70 also has an outlet or jet 74 positioned within a nozzle 78 in a chamber 76. The nozzle 78 is mounted for movement up and down and to the left and right, whereby the direction of the propulsion force for the watercraft 20 may be varied.

Figure 5:
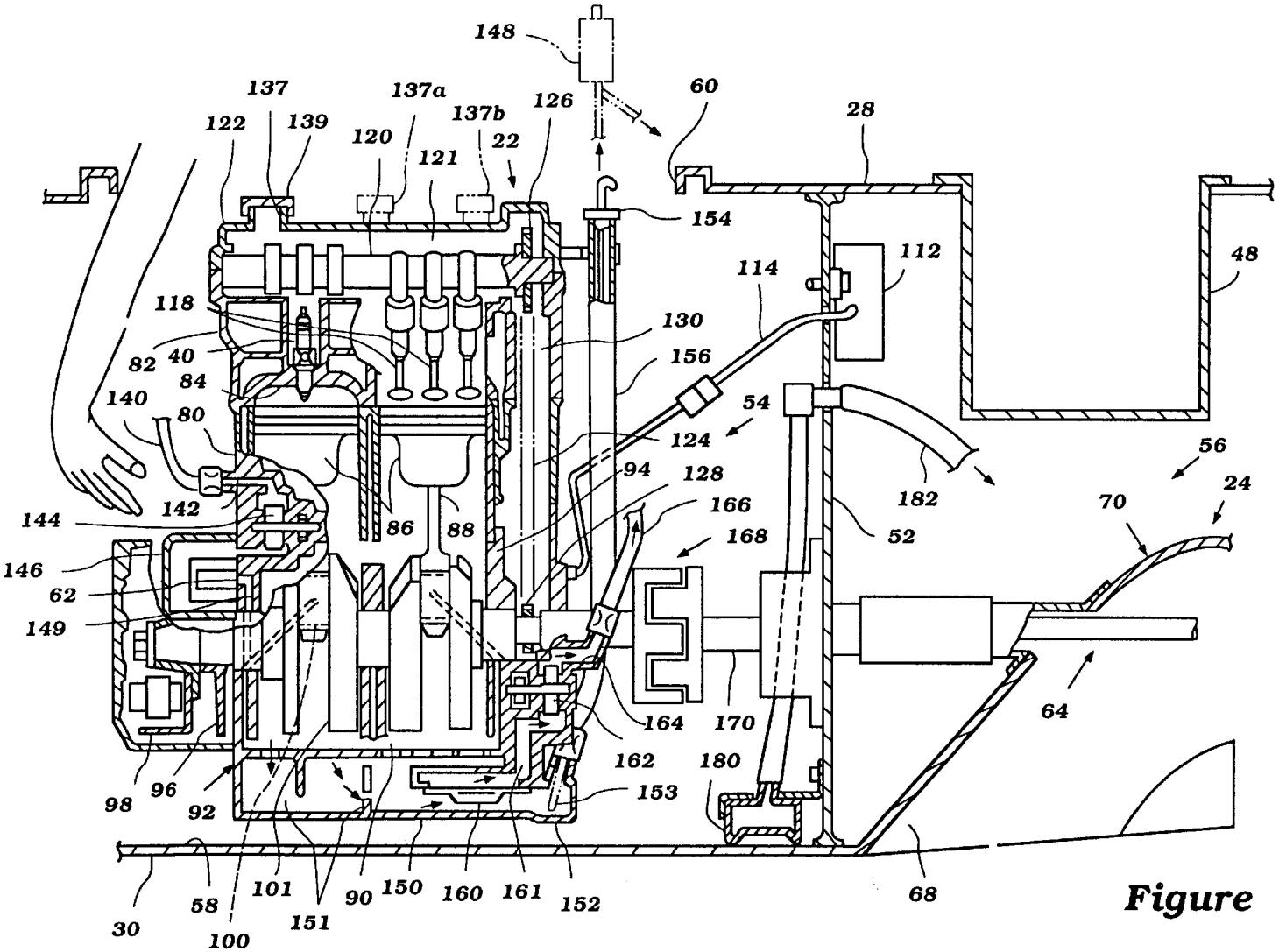
FIG. 5 is a enlarged cross-sectional side view of the engine and surrounding watercraft structure of the watercraft illustrated in FIG. 2.
Figure 6:
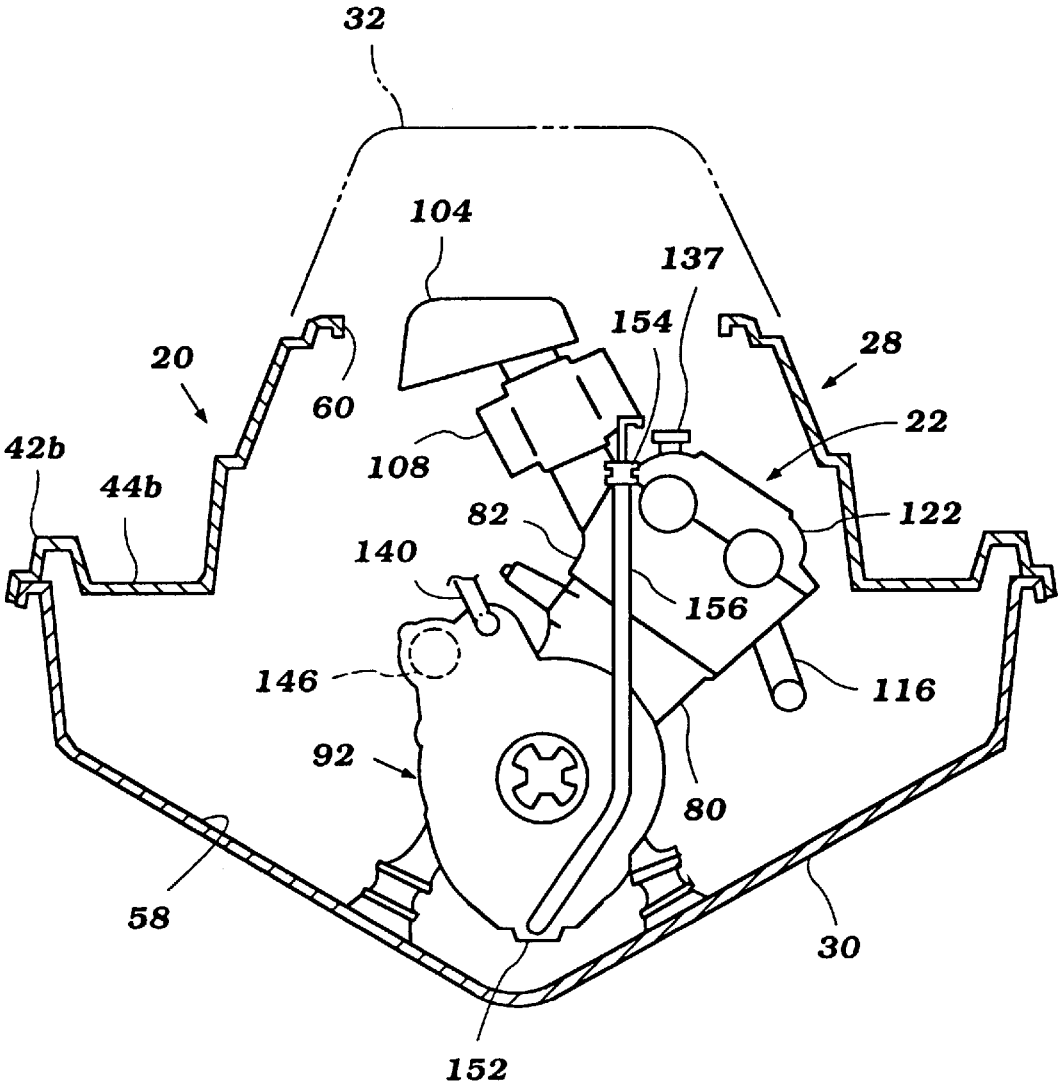
FIG. 6 is a cross-sectional end view of the watercraft illustrated in FIG. 2.

The engine 22 is best illustrated in FIGS. 2 and 5. As illustrated therein, the engine 22 is preferably of the two-cylinder, four-cycle variety. Of course, the engine 22 may have as few as one, or more than two, cylinders, as may be appreciated by one skilled in the art.

The engine 22 includes a cylinder block 80 having a cylinder head 82 connected thereto and cooperating therewith to define two combustion chambers 84. A piston 86 is movably mounted in each cylinder, and connected to the crankshaft 62 via a connecting rod 88.

The crankshaft 62 is rotatably journalled with respect to the cylinder block 80 within a crankcase chamber 90. Preferably, the chamber 90 is defined by a crankcase cover member 92 which extends from a bottom portion of the cylinder block 80. In addition, the crankcase member 90 has a number of support walls 94 with respect to which the crankshaft 62 is rotatably journalled.

A toothed or cogged starter gear 96 is positioned on a front end of the crankshaft 62 extending through a front of the support walls 94. In addition, a flywheel 98 preferably has one or more magnets thereon for use in a pulser-coil arrangement. The flywheel 98 is provided on the crankshaft 62 adjacent the starter gear 96.

The crankshaft 62 preferably includes connecting pin portions 100 to which the connecting rods 88 are connected. The connecting pin portions 100 extend between counterweight portions 101 of the crankshaft, as is well known in the art.

The engine 22 includes means for providing an air and fuel mixture to each combustion chamber 84. Preferably, air is drawn into the engine compartment 54 through a pair of air inlets 102 in the hull 26, as illustrated in FIG. 2. Air is then drawn into an air intake 104 to an air intake passage leading to each combustion chamber 84. Preferably, the flow of air into each combustion chamber 84 is regulated by at least one intake valve (not shown), as is well known to those skilled in the art. The intake valves are operated by an intake camshaft 85 (illustrated schematically in FIG. 4).

Preferably, fuel is provided to each combustion chamber 84 with the incoming air. In particular, fuel is drawn from a fuel tank 106 positioned in the engine compartment 54, by a fuel pump (not shown), and delivered to a carburetor 108 positioned along each intake passage. A throttle control (not shown) is preferably provided for allowing the watercraft operator to control the rate of fuel and air delivery to the engine 22 for controlling the speed and power output of the engine. It is contemplated that the fuel may be provided by indirect or direct fuel injection, as well as via carburation, as known in the art.

A suitable ignition system is provided for igniting the air and fuel mixture provided to each combustion chamber 84. Preferably, this system comprises a spark plug 110 corresponding to each combustion chamber 84. The spark plugs 110 are preferably fired by a suitable ignition system, which preferably includes an electronic control 112 connected to the engine 22 by one or more electrical cables 114. Preferably, the pulser-coil generates firing signals for the ignition system. In addition, the ignition system may include a battery 111 (see FIG. 2) and a magneto or alternator (not shown) for use in providing power to an electric starter and the like.

Exhaust gas generated by the engine 22 is routed from the engine to a point external to the watercraft 20 by an exhaust system which includes an exhaust manifold 116. Exhaust from each combustion chamber 84 is preferably expelled from the combustion chamber to the exhaust manifold 116 through three exhaust passages (not shown). Means are provided for controlling the flow of exhaust gases through these exhaust passages. Preferably, this means comprises an exhaust valve 118. The exhaust valves 118 are actuated by a common exhaust camshaft 120. The remainder of the exhaust system is disclosed in detail below.

The intake and exhaust camshafts are mounted for rotation with respect to the cylinder head 82. The camshafts are positioned within a camshaft chamber 121 formed by a camshaft cover 122 connected to the cylinder head 82.

Means are provided for rotating the camshafts 85,120 to effectuate movement of the intake and exhaust valves. Preferably, this means comprises a timing belt 124 which extends about a camshaft sprocket 126 positioned on an end of each camshaft and a drive pulley 128 mounted on the crankshaft 62. The timing belt 124 extends through a timing belt housing portion 130 of the engine 22.

The engine 22 includes a lubricating system for providing lubricating oil to the various moving parts thereof. Preferably, the lubricating system is of the "dry-sump" variety, and includes an oil tank or reservoir 132 provided separate from the engine. As illustrated in the embodiment in FIG. 2, the reservoir 132 is connected to the outside of a hatch portion 134 of the hull 26. The reservoir 132 has a fill spout 136 and is preferably obscured under a visor 138 positioned just in front of the steering handle 40. As illustrated in FIG. 2, the oil reservoir 132 is positioned so that air passing along the top surface of the hull 26 passes under the visor 138 and around the reservoir, thereby cooling the oil therein.

An oil supply line or hose 140 extends from the reservoir 132 to a supply port 142 extending into the cylinder block 80. An oil pump 144 is provided for pumping the oil through an oil filter 146, and then through the oil gallery, including a main gallery 149, of the engine 22. The oil filter is positioned so as to be accessible through the maintenance opening 60. As such, the oil filter 146 does not extend from the bottom of the engine. Most preferably, the oil filter 146 extends outwardly from the front end of the engine 22.

The oil eventually drains into a oil collector 150. Preferably, a baffle plate 151 is provided in the collector 150 for retarding the movement of the oil therein, preventing frothing of the oil and the like.

The oil partially fills a pool area 152 at the end of the collector 150. An end 153 of a ullage rod 154 extending through a housing 156 allows the operator of the craft to determine if oil is being supplied to the engine.

Oil which is drawn into the collector 150 is subsequently drawn upwardly through a filter or screen 160 into a passage 161 leading to a return pump 162. The return pump 162 delivers the oil through an outlet passage 164 and through a return hose or pipe 166 back to the oil reservoir 132.

Oil may be added to the lubricating system through an oil fill spout 137 formed in the top of the camshaft cover 122. A lid or cover 139 is provided for enclosing the spout. While the spout 137 is preferably positioned at the front end of the engine 22 as illustrated in FIG. 5, it may be alternatively positioned mid-way along or at the opposite end of the cover 122 as illustrated by positions 137*a* and 137*b*. It is desired that the spout for lubricating oil addition be positioned for access through the maintenance opening 60.

If the lubricating oil needs to be drained from the engine, an intake line of a vacuum pump 148 may be extended through the ullage rod housing 156 into the pool 152.

As stated above, the crankshaft 62 drives the impeller 72 of the propulsion unit 24. In particular, the end of the crakshaft 62 extends through the crankcase cover 92 to a coupling 168, where it is coupled to a first end 170 of the impeller shaft 64.

As best illustrated in FIG. 2, the exhaust manifold 116 is connected to a first portion 172 of an exhaust pipe 174. The exhaust pipe 174 leads to a water lock 176, as well known in the art, and thereon to a second portion of the exhaust pipe 178. The second portion of the exhaust pipe 178 terminates in the chamber 76, where the exhaust gases from the engine 122 are discharged.

Preferably, the watercraft 20 includes a bilge 180 having a screened inlet positioned along the bottom 58 of the hull 26 within the engine compartment 54. A hose 182 leads from the bilge 180 for discharging water pumped from the engine compartment 54 from the watercraft 20.

Figure 7:
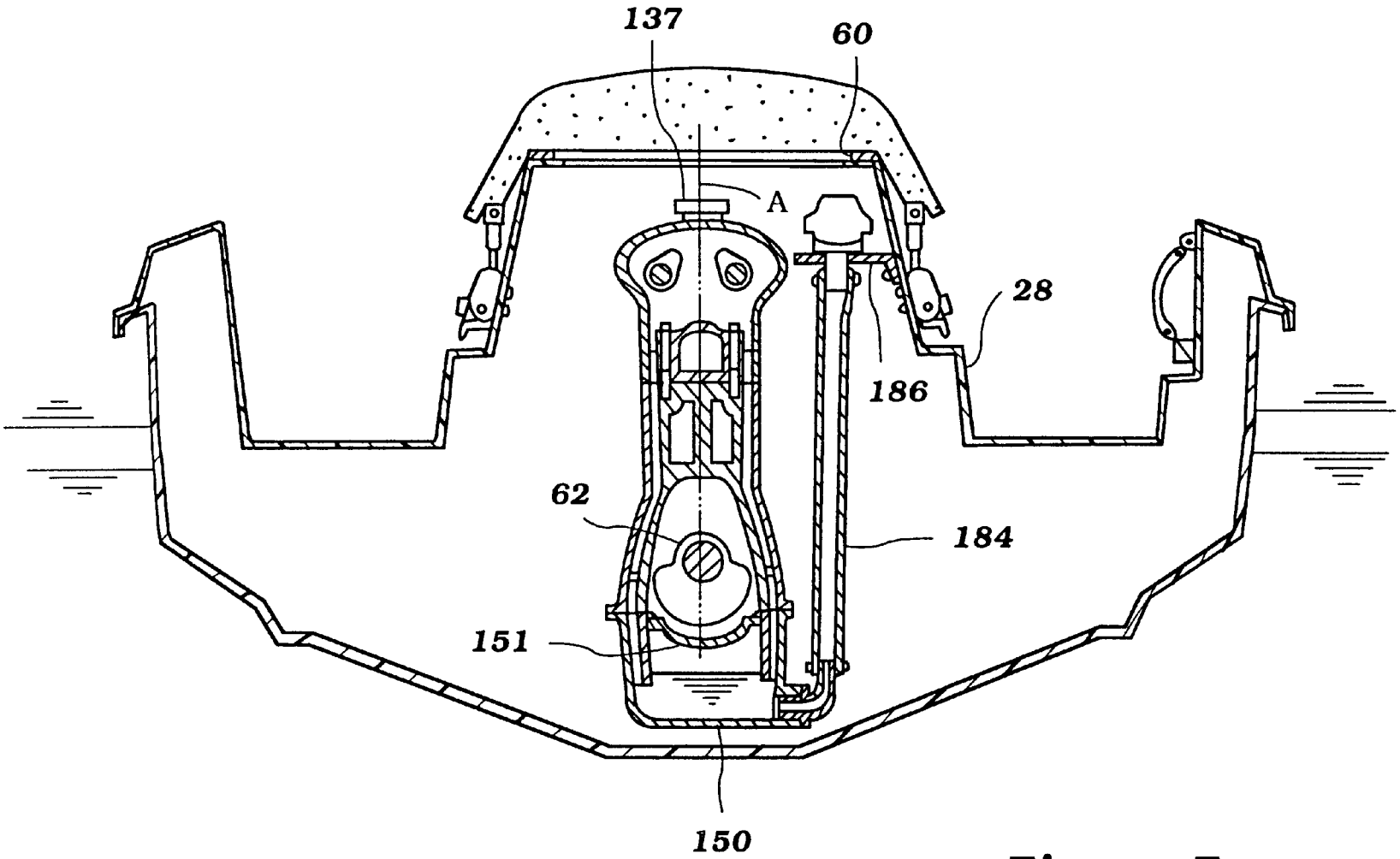
FIG. 7 is yet another cross-sectional end view of a watercraft similar to that illustrated in FIG. 2 and illustrating an alternate oil drain system.

FIG. 7 illustrates an alternate lubricating oil drain system for the engine 22. In this embodiment, a hose 184 has its first end in communication with an inlet positioned within the oil collector 150 at the bottom end of the engine 22. The opposite end of the hose 184 is connected to a support 186 near the maintenance opening 60 in the deck 28. Oil may be withdrawn from the engine 22 by pumping the oil through the hose 184 with a vacuum pump or similar apparatus.

The engine 22*a* having a lubricating system as disclosed above has several distinct advantages. First, the lubricating system arrangement allows a four-cycle engine to be conveniently utilized in a watercraft. Though positioned within the hull 26 of the watercraft, the lubricating system is accessible to the watercraft owner or operator. In particular, the oil fill is provided through a spout 110 positioned on the top of the camshaft cover 122. This orientation permits access to the oil fill by simply opening the maintenance access. In addition, the oil filter 146 is easily accessible for removal and change.

Figure 8:
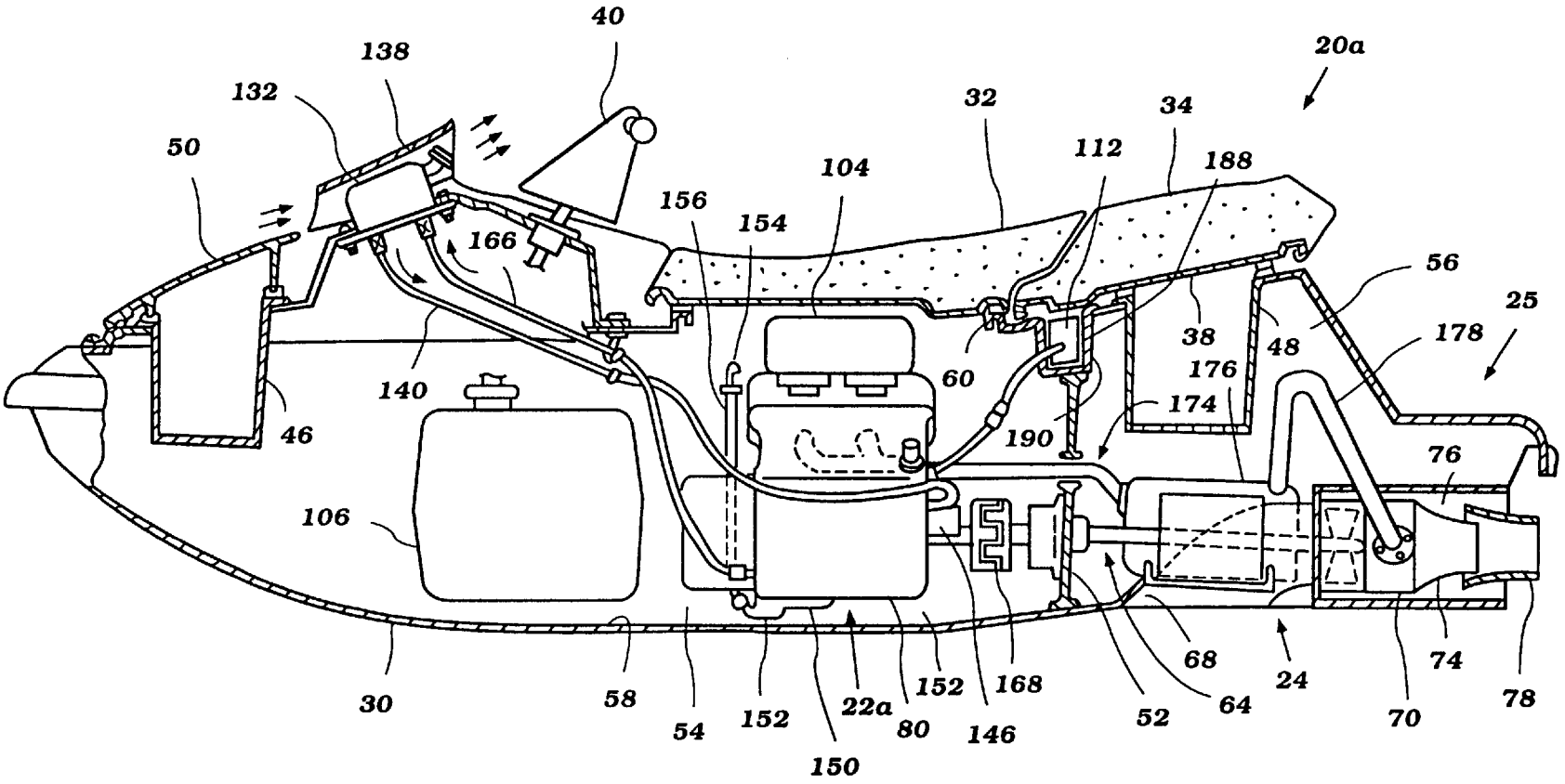
FIG. 8 is a cross-sectional view of a watercraft similar to that illustrated in FIG. 1 and including an engine having a lubricating system in accordance with second embodiment of the present invention.
Figure 9:
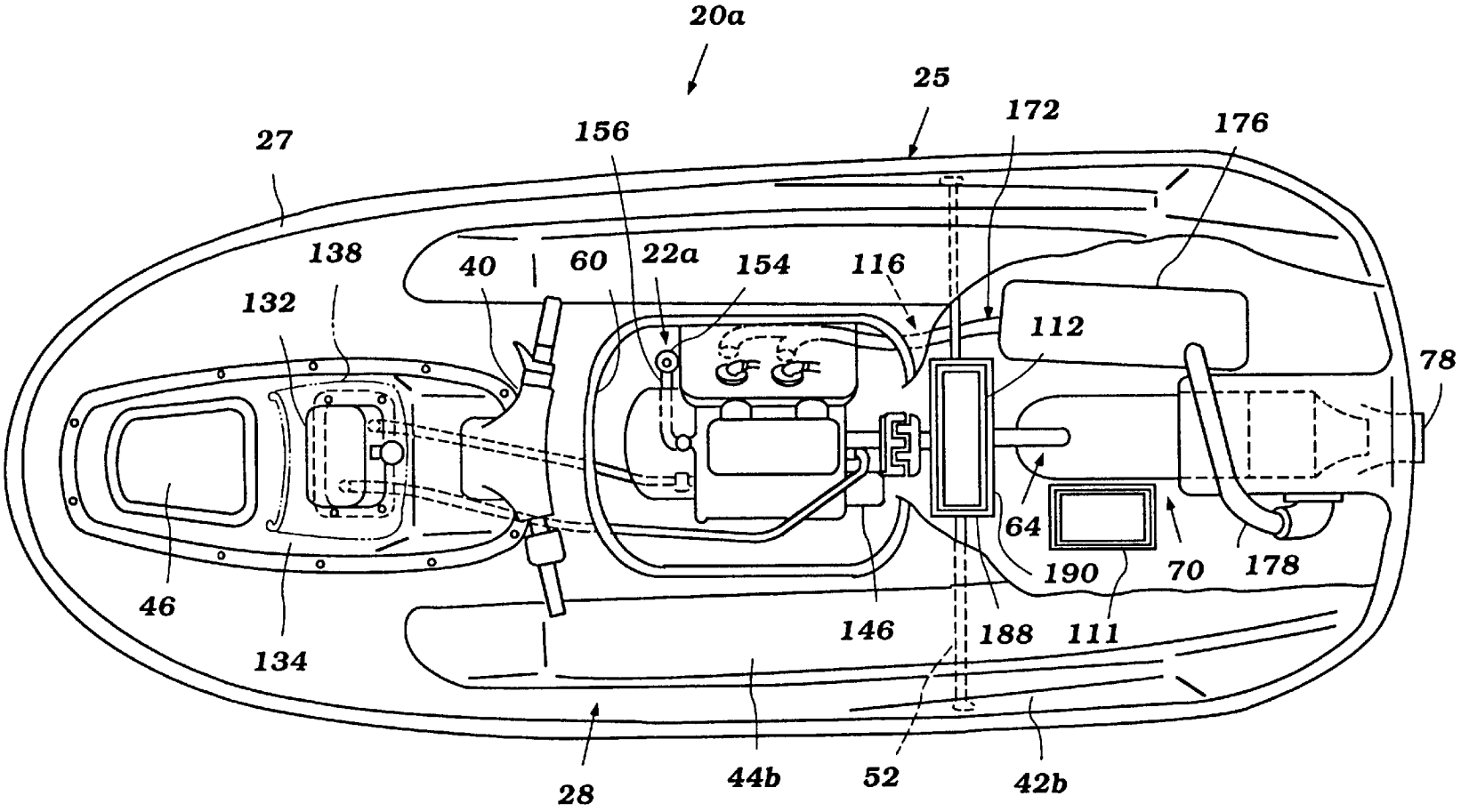
FIG. 9 is a top view of the watercraft illustrated in FIG. 8, with portions thereof cut-away to illustrate the engine therein.
Figure 10:
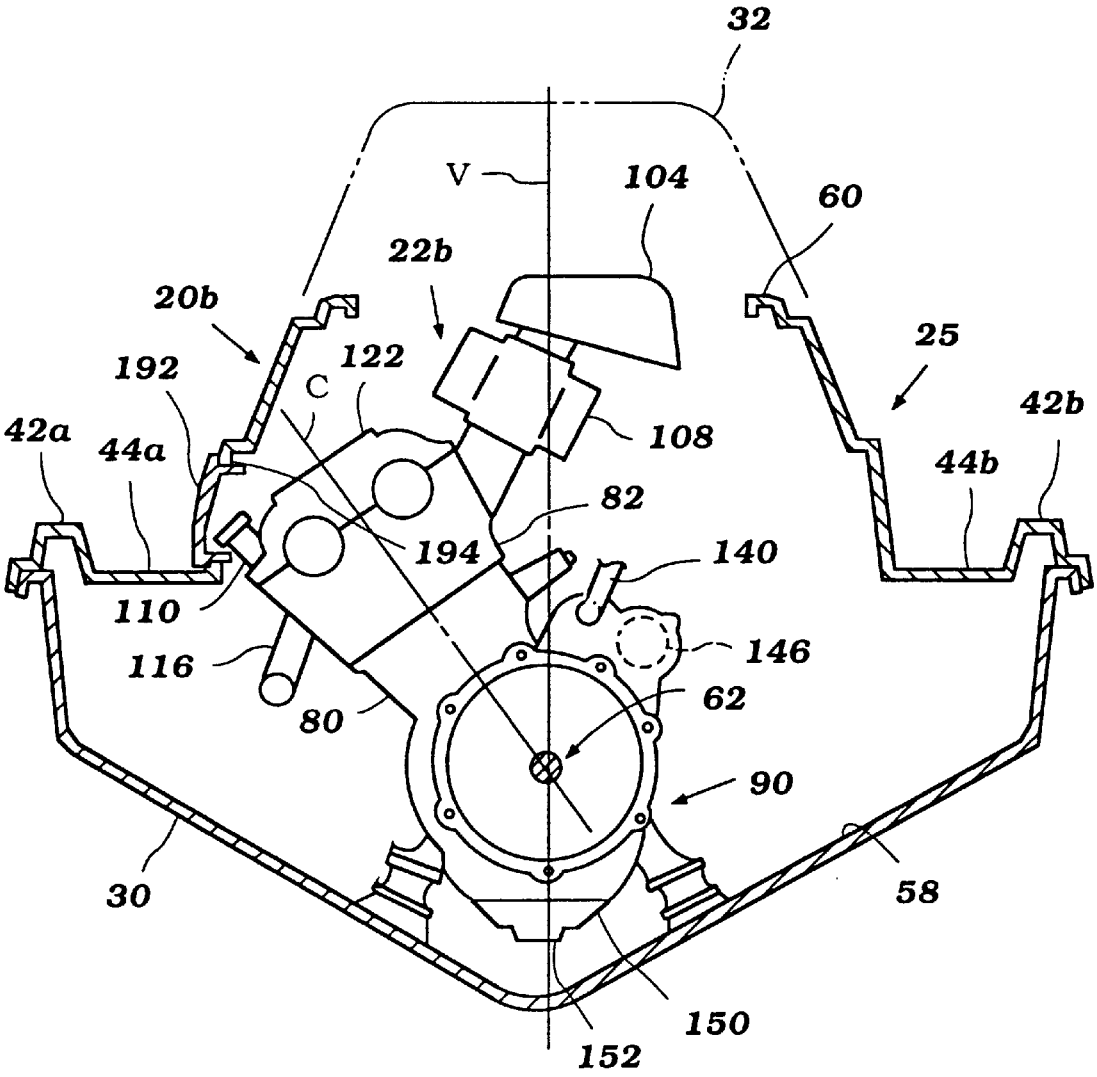
FIG. 10 is a cross-sectional end view of a watercraft powered by an engine having a lubricating system in accordance with a third embodiment of the present invention.
Figure 11:
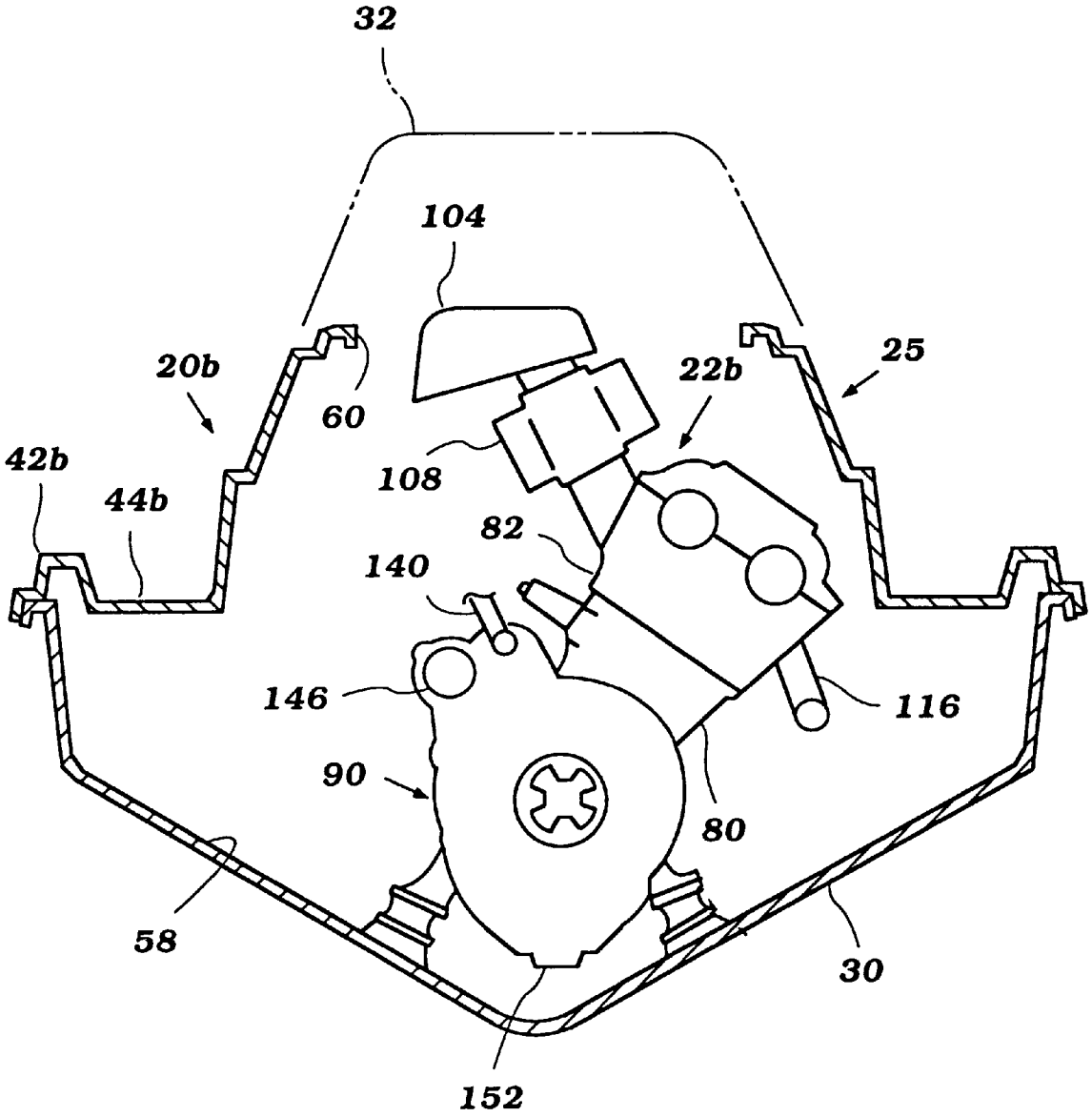
FIG. 11 is a opposite cross-sectional end view of the watercraft illustrated in FIG. 10.

FIGS. 8 and 9 illustrate a watercraft 20*a* powered by an engine 22*a* having a lubricating system in accordance with a second embodiment of the present invention. In these figures, like parts have been given like numerals to those described above in conjunction with the first embodiment illustrated in FIGS. 1–7.

As illustrated therein in FIGS. 8 and 9, the oil collector 150 is positioned at the front end of the bottom of the engine 22*a*, as opposed to the rear end, as in the first embodiment illustrated in FIG. 2. In this arrangement, the ullage rod 154 and housing 156 are positioned at the front end of the engine 22*a* as well.

Lubricating oil is supplied from the reservoir 132 to an inlet port in the rear end of the engine 22. There the oil passes through the oil filter 146 and through the engine 22*a* to the oil collector 150. The oil is then drawn, in a manner like that described above, to the return line 166 for return to the oil reservoir 132.

While not important to the present invention, also illustrated in FIGS. 8 and 9 is the manner by which the electronic control 112 may be positioned within a chamber 188 formed by a casing 190 dividing the engine and pumping compartments 54,56.

FIGS. 10–13 illustrate a watercraft 20*b* powered by an engine 22*b* having a lubricating system in accordance with a third embodiment of the present invention. In these figures, like parts have been given like numerals to those described above in conjunction with the first embodiment illustrated in FIGS. 1–7.

As illustrated therein, the combustion chambers are tilted along an axis C which is offset from a vertical axis V extending through the crankshaft 62. In this arrangement, the oil spout or fill 110 is preferably positioned within the camshaft cover 122 at a location below the axis C (i.e. and not between the axis C and V). An access port 194 is provided in a side portion of the top deck 26 extending upwardly from the step 44*a*. The port 194 is defined by a cover or hatch 192 provided in the deck 26.

Figure 12:
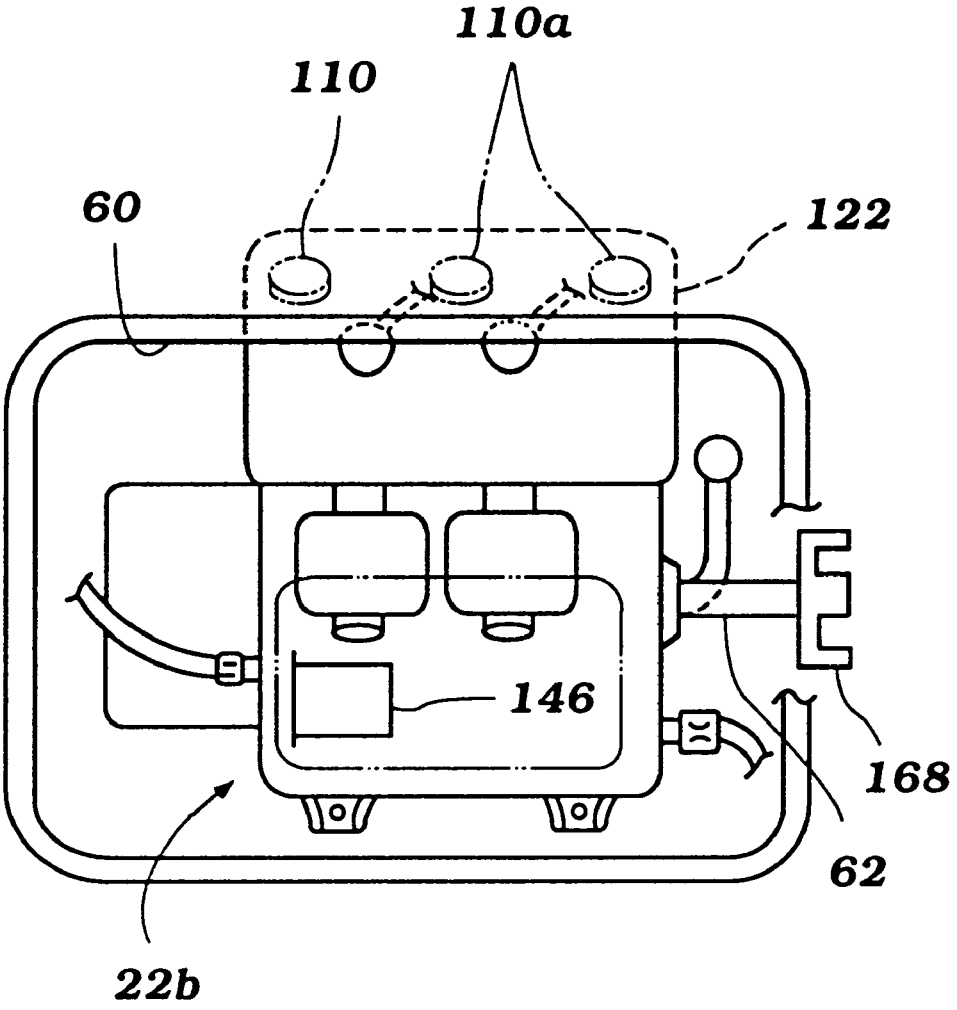
FIG. 12 is a top view illustrating the engine of the watercraft illustrated in FIG. 10.
Figure 13:
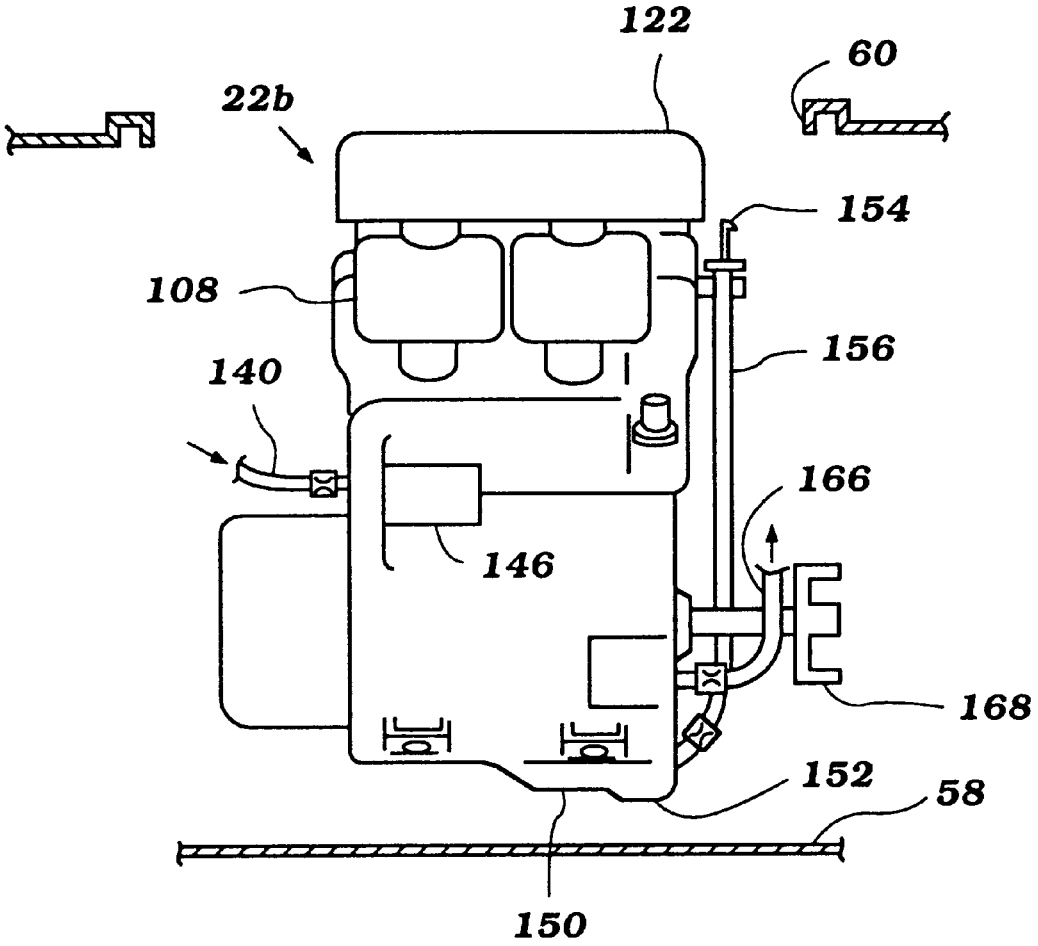
FIG. 13 is a side view illustrating the engine of the watercraft illustrated in FIG. 10.

In this embodiment, the oil filter 146 is preferably positioned on the side of the engine 22*b* facing upwardly (i.e., on the side of the axis V opposite the axis C), whereby the filter 146 remains accessible through the maintenance opening 60 under the front seat 32. In addition, the oil fill or spout 110 is accessible through the access port 194 by removing the cover 192. As best illustrated in FIG. 12, the fill spout 110 may be positioned anywhere along the length of the camshaft cover 122, including alternate positions 110*a*. Regardless of the position of the spout 110, however, it is desired that it be accessible through the port 194.

Figure 14:
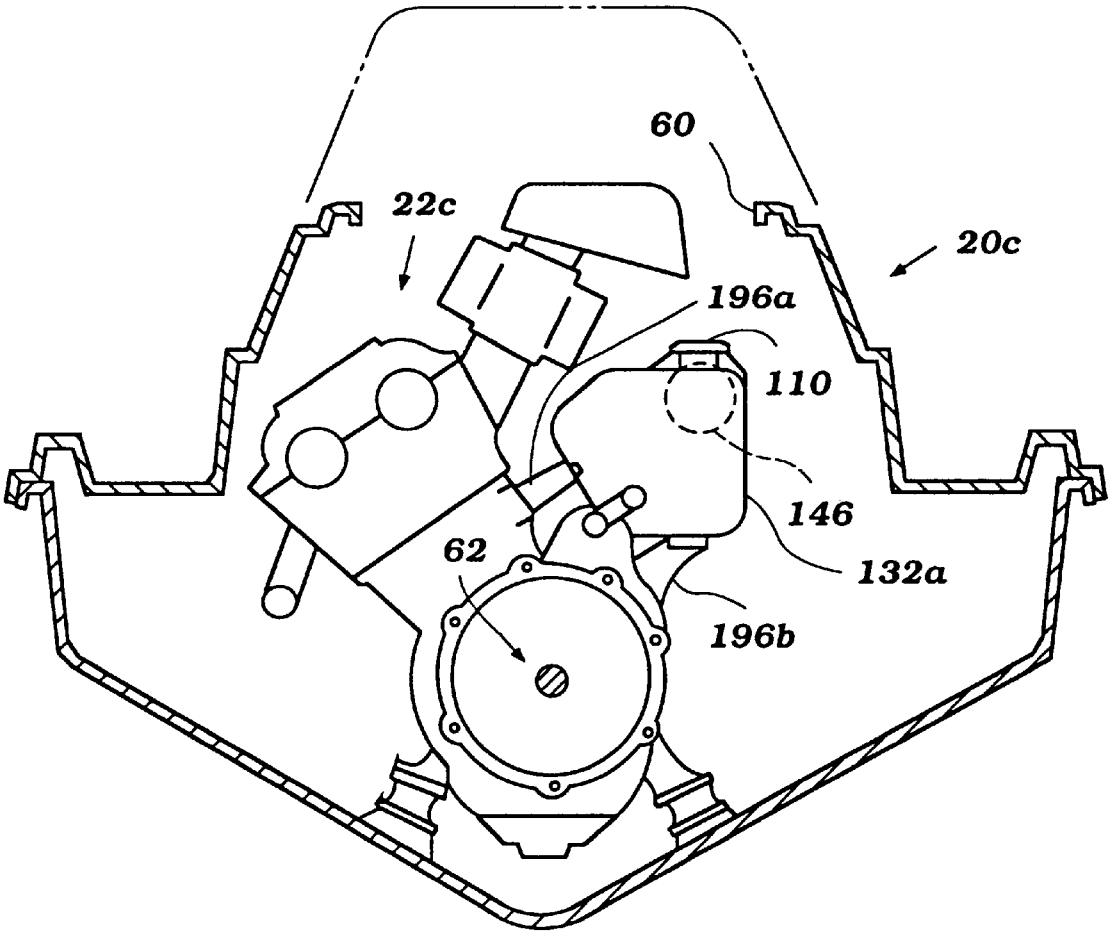
FIG. 14 is a cross-sectional front view of a watercraft having a lubricating system in accordance with a fourth embodiment of the present invention.
Figure 15:
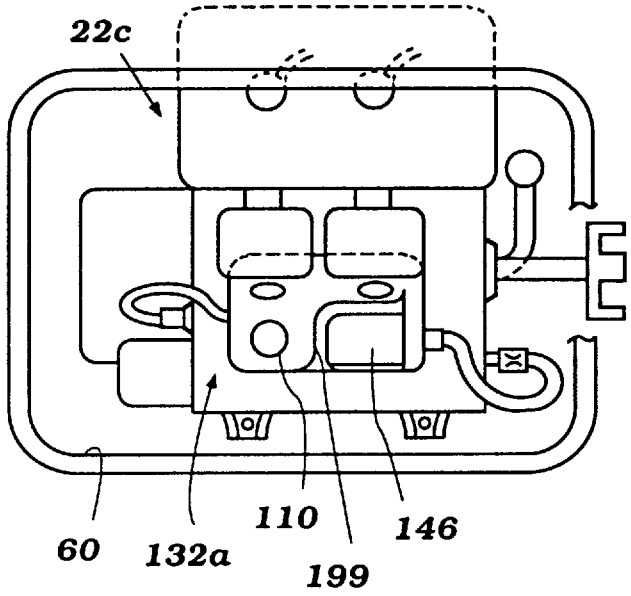
FIG. 15 is a top view of the engine illustrated in FIG. 14.
Figure 16:
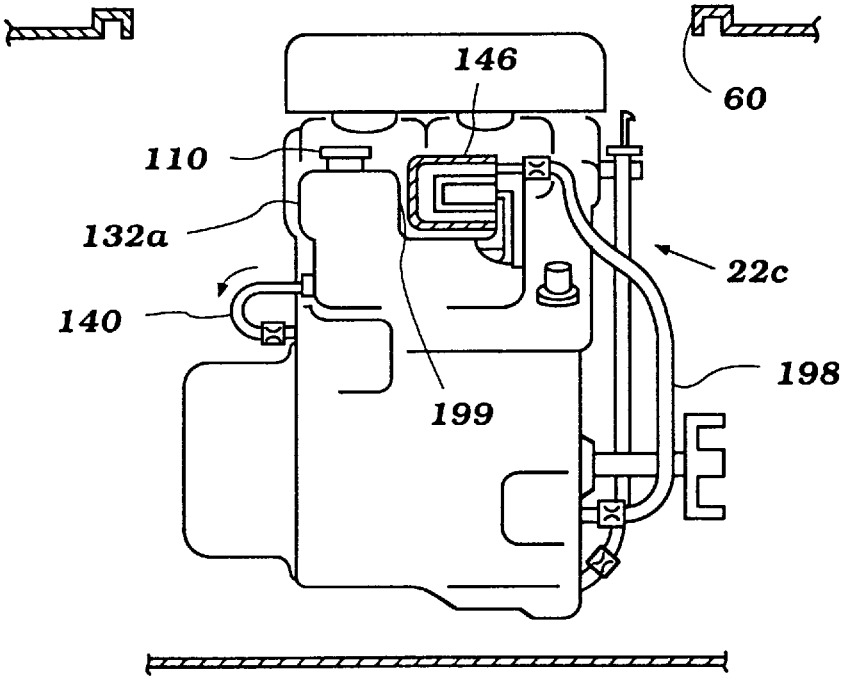
FIG. 16 is a side view of the engine illustrated in FIG. 15.

FIGS. 14–16 illustrate a watercraft 20*c* powered by an engine 22*c* having a lubricating system in accordance with a fourth embodiment of the present invention. In these figures, like parts have been given like numerals to those described above in conjunction with the first embodiment illustrated in FIGS. 1–7.

In this embodiment, an oil reservoir 132*a* is provided adjacent the engine 22*c*, instead of mounted upon the deck 28 of the hull 26. As illustrated therein, the reservoir 132*a* is mounted upon one or more supports 196*a,b* which extend from the cylinder block 80. Preferably, the reservoir 132*a* is mounted in a position above the crankshaft 62.

As better illustrated in FIGS. 15 and 16, the oil reservoir 132*a* has a fill spout 110 positioned in a top surface thereof, facing in the direction of the maintenance opening 60. Preferably, the oil filter 146 is positioned within a recessed area 199 of the reservoir 132*a* The oil filter 146 has its inlet in communication with the reservoir 132*a* and its outlet leading to an engine lubricant supply line 198.

In all embodiments, the oil filter 146 is preferably positioned above the drain provided for removing the oil from the engine. More preferably, the oil filter 146 is positioned at the height above the crankshaft 62 of the engine.

Of course, the foregoing description is that of preferred embodiments of the invention, and various changes and modifications may be made without departing from the spirit and scope of the invention, as defined by the appended claims.

What is claimed is:

1. A watercraft comprising a water propulsion device powered by a four-cycle internal combustion engine, the engine mounted in an engine compartment defined by a deck connected to a hull of the watercraft, a removable deck member selectively positioned above a maintenance opening in the deck for accessing the engine in the engine compartment, the engine comprising at least one cylinder, an output shaft and a lubrication system, the lubrication system comprising a reservoir, a fill tube, and a filter wherein at least one of the reservoir, the fill tube, and the filter is accessible through the maintenance opening.

2. The watercraft of claim 1, wherein the engine further comprises a valve cover, the fill tube is arranged on the valve cover and is accessible through the maintenance opening.

3. The watercraft of claim 2, wherein the output shaft has an output shaft axis and the cylinder is inclined along an incline axis, a vertical plane is defined through the output shaft axis and an inclined plane is defined by the incline axis and the output shaft axis, and the fill tube is arranged on the opposite side of the inclined plane from the vertical plane.

4. The watercraft of claim 1, wherein the output shaft has an output shaft axis and the cylinder is inclined along an incline axis, a vertical plane is defined through the output shaft axis and an inclined plane is defined by the incline axis and the output shaft axis, and the fill tube is positioned between the vertical plane and the inclined plane.

5. The watercraft of claim 4, wherein the reservoir is arranged remotely from the engine and attached to the fill tube.

6. The watercraft of claim 1 further comprising an access port defined within the hull adjacent to the fill tube, and a removable hatch selectively positionable to close the access port, the access port being positioned such that the fill tube may be easily accessed through the access port.

7. The watercraft of claim 1, wherein the reservoir is arranged higher than the output shaft relative to a bottom of the watercraft, and the fill tube is arranged on the reservoir so as to be accessible through the maintenance opening.

8. The watercraft of claim 7 wherein the reservoir is arranged at least partially within the engine compartment.

9. The watercraft of claim 7, wherein the cylinder is inclined, a vertical plane is defined through an axis of the output shaft, the reservoir is arranged on one side of the vertical plane and the inclined cylinder is arranged on the other side of the vertical plane.

10. The watercraft of claim 1 further comprising a longitudinally-extending straddle-type seat arranged generally above the engine compartment.

11. The watercraft of claim 10, wherein the longitudinally-extending straddle-type seat is comprised of a forward portion and a rearward portion, the forward portion being removable separately from the rearward portion.

12. The watercraft of claim 1 further comprising pumping chamber arranged beneath a rear-portion of the watercraft hull.

13. The watercraft of claim 12 further comprising a means for propelling water arranged within the pumping chamber.

14. The watercraft of claim 1, wherein the reservoir is positioned at the bottom of the engine.

15. The watercraft of claim 1, wherein the engine is of the dry-sump type of engine.

16. A watercraft comprising a water propulsion device powered by a four-cycle internal combustion engine, the engine mounted in an engine compartment defined by a deck connected to a hull of the watercraft, a removable deck member selectively positioned above a maintenance opening in the deck for accessing the engine in the engine compartment, the engine comprising at least one cylinder, an output shaft and a lubrication system, the lubrication system comprising an oil collector, a fill tube, and a filter wherein at least one of the oil collector, the fill tube and the filter is accessible through the maintenance opening.

17. The watercraft of claim 16, wherein the oil collector is positioned lower than an axis of rotation of the output shaft relative to a bottom of the watercraft.

18. The watercraft of claim 17 further comprising a secondary oil reservoir positioned remotely from the oil collector and in fluid communication with the oil collector.

19. The watercraft of claim 17, wherein the engine is a dry-sump type of engine.

* * * * *